US011138989B2

(12) United States Patent
Seetharaman et al.

(10) Patent No.: US 11,138,989 B2
(45) Date of Patent: Oct. 5, 2021

(54) SOUND QUALITY PREDICTION AND INTERFACE TO FACILITATE HIGH-QUALITY VOICE RECORDINGS

(71) Applicant: ADOBE INC., San Jose, CA (US)

(72) Inventors: Prem Seetharaman, Evanston, IL (US); Gautham J. Mysore, San Francisco, CA (US); Bryan A. Pardo, Evanston, IL (US)

(73) Assignee: Adobe Inc., San Jose, CA (US)

( * ) Notice: Subject to any disclaimer, the term of this patent is extended or adjusted under 35 U.S.C. 154(b) by 109 days.

(21) Appl. No.: 16/296,122

(22) Filed: Mar. 7, 2019

(65) Prior Publication Data

US 2020/0286504 A1 Sep. 10, 2020

(51) Int. Cl.

| | |
|---|---|
| ***G10L 25/60*** | (2013.01) |
| ***G10L 25/30*** | (2013.01) |
| ***G10L 21/0232*** | (2013.01) |
| ***G10L 25/84*** | (2013.01) |
| *G10L 21/0208* | (2013.01) |

(52) U.S. Cl.

CPC ..... *G10L 25/60* (2013.01); *G10L 21/0232* (2013.01); *G10L 25/30* (2013.01); *G10L 25/84* (2013.01); *G10L 2021/02082* (2013.01)

(58) Field of Classification Search

CPC ..... G10L 25/60; G10L 25/30

See application file for complete search history.

(56) References Cited

U.S. PATENT DOCUMENTS

| | | | | |
|---|---|---|---|---|
| 5,729,658 | A * | 3/1998 | Hou | G10L 25/69 381/60 |
| 10,244,104 | B1 * | 3/2019 | Ireland | G06N 3/084 |
| 2002/0099551 | A1 * | 7/2002 | Jacob | H04R 29/00 704/270 |

(Continued)

OTHER PUBLICATIONS

Li, F. F., and T. J. Cox. "Speech transmission index from running speech: A neural network approach." The Journal of the Acoustical Society of America 113.4 (2003): 1999-2008. (Year: 2003).*

(Continued)

*Primary Examiner* — Shaun Roberts

(74) *Attorney, Agent, or Firm* — Shook, Hardy & Bacon L.L.P.

(57) ABSTRACT

Embodiments of the present invention provide systems, methods, and computer storage media for sound quality prediction and real-time feedback about sound quality, such as room acoustics quality and background noise. Audio data can be sampled from a live sound source and stored in an audio buffer. The audio data in the buffer is analyzed to calculate a stream of values of one or more sound quality measures, such as speech transmission index and signal-to-noise ratio. Speech transmission index can be calculated using a convolution neural network configured to predict speech transmission index from reverberant speech. The stream of values can be used to provide real-time feedback about sound quality of the audio data. For example, a visual indicator on a graphical user interface can be updated based on consistency of the values over time. The real-time feedback about sound quality can help users optimize their recording setup.

20 Claims, 5 Drawing Sheets

(56) References Cited

U.S. PATENT DOCUMENTS

| | | | | |
|---|---|---|---|---|
| 2004/0059578 | A1* | 3/2004 | Schulz | G10L 25/69 704/270 |
| 2005/0135637 | A1* | 6/2005 | Obranovich | G08B 29/10 381/92 |
| 2008/0255829 | A1* | 10/2008 | Cheng | H04B 17/0087 704/201 |
| 2010/0211395 | A1* | 8/2010 | Beerends | G10L 25/69 704/270 |
| 2013/0262103 | A1* | 10/2013 | Reiswig | H04R 29/007 704/235 |
| 2013/0297300 | A1* | 11/2013 | van Wijngaarden | G10L 25/60 704/220 |
| 2014/0214426 | A1* | 7/2014 | Kanevsky | G10L 15/18 704/257 |
| 2015/0030163 | A1* | 1/2015 | Sokolov | G10L 25/69 381/56 |
| 2015/0179186 | A1* | 6/2015 | Swierk | G06F 3/165 704/276 |
| 2015/0358756 | A1* | 12/2015 | Harma | H04S 7/302 381/17 |
| 2016/0217796 | A1* | 7/2016 | Frey | G10L 19/005 |
| 2020/0105291 | A1* | 4/2020 | Sheaffer | G10L 21/10 |

OTHER PUBLICATIONS

Seetharaman, Prem, Gautham J. Mysore, Paris Smaragdis, and Bryan Pardo. "Blind Estimation of the Speech Transmission Index for Speech Quality Prediction." In 2018 IEEE International Conference on Acoustics, Speech and Signal Processing (ICASSP), pp. 591-595. IEEE, 2018.

Seetharaman, Prem, Gautham Mysore, Bryan Pardo, Paris Smaragdis, and Celso Gomes. "VoiceAssist: Guiding Users to High-Quality Voice Recordings." (2019).

M. Unoki, K. Sasaki, R. Miyauchi, M. Akagi, and N. S. Kim, "Blind method of estimating speech transmission index from reverberant speech signals," in Signal Processing Conference (EUSIPCO), 2013 Proceedings of the 21st European, pp. 1-5, IEEE, 2013.

Seetharaman, P., Mysore, G., Pardo, B., Smaragdis, P., & Gomes, C. (2019). VoiceAssist: Guiding Users to High-Quality Voice Recordings. In the ACM Conference on Human Factors in Computing Systems (CHI 2019). 6 pages.

Seetharaman, P., Mysore, G. J., Smaragdis, P., & Pardo, B. (Apr. 2018). Blind Estimation of the Speech Transmission Index for Speech Quality Prediction. In 2018 IEEE International Conference on Acoustics, Speech and Signal Processing (ICASSP) (pp. 591-595). IEEE.

A. W. Rix, J. G. Beerends, M.P. Hollier, and A. P. Hekstra, "Perceptual evaluation of speech quality (pesq)—a new method for speech quality assessment of telephone networks and codecs," in Acoustics, Speech, and Signal Processing, 2001. Proceedings. (ICASSP'OI), vol. 2, pp. 749-752, IEEE, 2001.

T. Thiede, W. C. Treumiet, R. Bitto, C. Schmidmer, T. Sporer, J. G. Beerends, and C. Colomes, "Peaq-the itu standard for objective measurement of perceived audio quality," Journal of the Audio Engineering Society, vol. 48, No. 1/2, pp. 3-29, 2000.

C. H. Taal, R. C. Hendriks, R. Heusdens, and J. Jensen, "A short-time objective intelligibility measure for timefrequency weighted noisy speech," in Acoustics Speech and Signal Processing (ICASSP), 2010 IEEE International Conference on, pp. 4214-4217, IEEE, 2010.

T. Houtgast and H. J. Steeneken, "The modulation transfer function in room acoustics as a predictor of speech intelligibility," Acta Acustica United With Acustica, vol. 28, No. 1, pp. 66-73, 1973.

T. Houtgast, H. Steeneken, W. Ahnert, L. Braida, R. Drullman, J. Festen, K. Jacob, P. Mapp, S. McManus, K. Payton, et al., "Past, present and future of the speech transmission index," Soesterberg: TNO, p. 73, 2002. [Uploaded in Two Parts].

G.-B. Stan, J.-J. Embrechts, and D. Archambeau, "Comparison of different impulse response measurement techniques," Journal of the Audio Engineering Society, vol. 50, No. 4,pp. 249-262, 2002.

T. H. Falk, C. Zheng, and W.-Y. Chan, "A non-intrusive quality and intelligibility measure of reverberant and dereverberated speech," IEEE Transactions on Audio, Speech, and Language Processing, vol. 18, No. 7, pp. 1766-1774,2010.

R. Ratnam, D. L. Jones, B. C. Wheeler, W. D. O'BrienJr, C. R. Lansing, and A. S. Feng, "Blind estimation of reverberation time," The Journal of the Acoustical Society of America, vol. 114, No. 5, pp. 2877-2892, 2003.

J. Y. Wen, E. A. Habets, and P. A. Naylor, "Blind estimation of reverberation time based on the distribution of signal decay rates," in Acoustics, Speech and Signal Processing, 2008. ICASSP 2008. IEEE International Conference on, pp. 329-332, IEEE, 2008.

X. Xiao, S. Zhao, X. Zhong, D. L. Jones, E. S. Chng, and H. Li, "Learning to estimate reverberation time in noisy and reverberant rooms," in Sixteenth Annual Conference of the International Speech Communication Association, 2015.

E. Manilow, P. Seetharaman, F. Pishdadian, and B. Pardo, "Predicting algorithm efficacy for adaptive multi-cue source separation," in IEEE Workshop on Applications of Signal Processing to Audio and Acoustics, 2017. WASPAA' 17., 2017.

H. Pan, R. Scheibler, E. Bezzam, I. Dokmanic, and M. Vetterli, "Frida: Fri-based doa estimation for arbitrary array layouts," in Acoustics, Speech and Signal Processing (ICASSP), 2017 IEEE International Conference on, pp. 3186-3190, IEEE, 2017.

J. B. Allen and D. A. Berkley, "Image method for efficiently simulating small-room acoustics," The Journal of the Acoustical Society of America, vol. 65, No. 4, pp. 943-950, 1979.

K. Kinoshita, M. Delcroix, S. Gannot, E. A. Habets, R. Haeb-Umbach, W. Kellermann, V. Leutnant, R. Maas, T. Nakatani, B. Raj, et al., "A summary of the reverb challenge: state-of-the-art and remaining challenges in reverberant speech processing research," EURASIP Journal on Advances in Signal Processing, vol. 2016, No. I, p. 7, 2016.

D. Kingma and J. Ba, "Adam: A method for stochastic optimization," arXiv preprint arXiv:I412.6980, 2014.

Michael Berouti, Richard Schwartz, and John Makhoul. 1979. Enhancement of speech corrupted by acoustic noise. In Acoustics, Speech, and Signal Processing, IEEE International Conference on ICASSP'79., vol. 4. IEEE, 208-211.

Scott Carter, John Adcock, John Doherty, and Stacy Branham. 2010. NudgeCam: Toward targeted, higher quality media capture. In Proceedings of the 18th ACM international conference on Multimedia. ACM, 615-618.

Mark Cartwright, Bryan Pardo, Gautham J Mysore, and Matt Hoffman. 2016. Fast and easy crowdsourced perceptual audio evaluation. In Acoustics, Speech and Signal Processing (ICASSP), 2016 IEEE International Conference on. IEEE, 619-623.

Ana Ramirez Chang and Marc Davis. 2005. Designing systems that direct human action. In CH/'05 Extended Abstracts on Human Factors in Computing Systems. ACM, 1260-1263 [Uploaded in Two Parts].

Marc Davis. 2003. Active capture: integrating human-computer interaction and computer vision/audition to automate media capture. In Multimedia and Expo, 2003. ICME'03. Proceedings. 2003 International Conference on, vol. 2. IEEE, II-185.

Jeffrey Heer, Nathaniel S Good, Ana Ramirez, Marc Davis, and Jennifer Mankoff. 2004. Presiding over accidents: system direction of human action. In Proceedings of the SIGCHI Conference on human factors in computing systems. ACM, 463-470.

Kazutaka Kurihara, Masataka Goto, Jun Ogata, Yosuke Matsusaka, and Takeo Igarashi. 2007. Presentation sensei: a presentation training system using speech and image processing. In Proceedings of the 9th international conference on Multimodal interfaces. ACM, 358-365.

Patrick A Naylor and Nikolay D Gaubitch. 2010. Speech dereverberation. Springer Science & Business Media.

Santiago Pascual, Antonio Bonafonte, and Joan Serra. 2017. SEGAN: Speech enhancement generative adversarial network. arXiv preprint arXiv: 1703.09452 (2017).

(56) References Cited

OTHER PUBLICATIONS

Cyril Plapous, Claude Marro, and Pascal Scalart. 2006. Improved signal-to-noise ratio estimation for speech enhancement. IEEE Transactions on Audio, Speech, and Language Processing 14, 6 (2006), 2098-2108.

Steve Rubin, Floraine Berthouzoz, Gautham J Mysore, and Maneesh Agrawala. 2015. Capture-time feedback for recording scripted narration. In Proceedings of the 28thAnnualACM Symposium on User Interface Software & Technology. ACM, 191-199.

Mike Senior. 2018. How can I remove background noise from a voice recording? (Oct. 2018). https://www.soundonsound.com/soundadvice/q-how-can-i-remove-background-noise-voice-recording.

Jongseo Sohn, Nam Soo Kim, and Wonyong Sung. 1999. A statistical model-based voice activity detection. IEEE signal processing letters 6, 1 (1999), 1-3.

M. R. Schroeder, "Integrated-impulse method measuring sound decay without using impulses," The Journal of the Acoustical Society of America, vol. 66, No. 2, pp. 497-500, 1979.

* cited by examiner

SOUND QUALITY PREDICTION AND INTERFACE TO FACILITATE HIGH-QUALITY VOICE RECORDINGS

BACKGROUND

Voice recording is a challenging task with many pitfalls due to sub-par recording environments, mistakes in recording setup, microphone quality, and the like. Newcomers to voice recording often have difficulty recording their voice, leading to recordings with low sound quality. Many amateur recordings of poor quality have two key problems: too much reverberation (echo), and too much background noise (e.g. fans, electronics, street noise, etc.).

SUMMARY

Embodiments of the present invention are directed to sound quality prediction and real-time feedback about sound quality, such as room acoustics quality and background noise. Audio data can be sampled from a sound source, such as a live performance, and stored in an audio buffer. The audio data in the buffer is analyzed to calculate a stream of values of one or more sound quality measures, such as speech transmission index and signal-to-noise ratio. Speech transmission index can be calculated using a convolution neural network configured to predict speech transmission index from reverberant speech. Signal-to-noise ratio can be calculated using a voice activity detector to segment speech data from noise and estimating signal-to-noise ratio by comparing the volumes of speech and noise segments. The stream of values can be used to provide real-time feedback about sound quality of the audio data. For example, a visual indicator on a graphical user interface can be updated based on consistency of the values over time. The real-time feedback about sound quality can help users optimize their recording setup.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The present invention is described in detail below with reference to the attached drawing figures, wherein.

DETAILED DESCRIPTION

Overview

Figure 1:
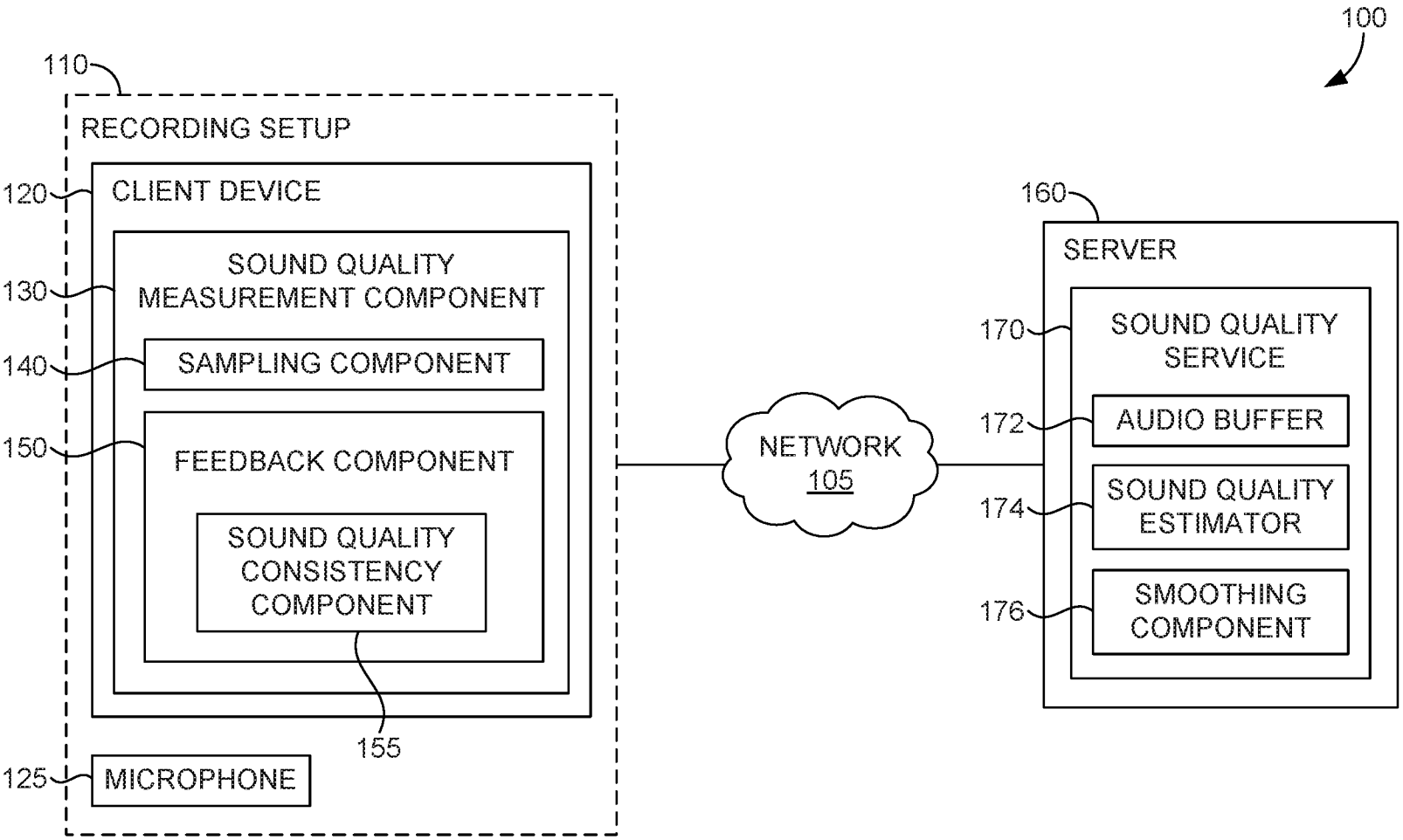
FIG. 1 is a block diagram of an example computing system for facilitating real-time sound quality feedback, in accordance with embodiments of the present invention.

Voice and, more generally, sound recording are central to the production of audio and audiovisual media, such as podcasts, educational content, film, advertisements, video essays, and radio. Newcomers to voice recording often make mistakes when recording their voice, leading to a poor recording. High recording quality is a hallmark of successful voice-based media (e.g., radio broadcast such as NPR® or popular podcasts and YOUTUBE® channels). Two key problems in many amateur recordings of poor quality are suboptimal room acoustics (reverberation) and too much background noise (e.g., fans, electronics, street noise).

A common conventional sound recording workflow is to record a "take" and then apply audio enhancement tools to the recording to improve its quality, generally during post-processing of the recording. Denoising tools have been used to reduce unwanted background noise. Dereverberation tools have been used to reduce the impact of a room and echos within the room on the recording. However, the output of these tools is imperfect, with noticeable distortions and artifacts on the resultant audio.

When a professional recording engineer and recording studio are available, the engineer generally provides feedback and guidance on microphone placement and recording technique, resulting in a high-quality recording with little need for denoising or dereverberation. For many applications, however, a recording engineer and studio may not be practical or readily available. People may wish to record late at night, in their home, or without prior scheduling. The nature of the project may not allow for the expense of a recording engineer and studio. Conventional amateur recording software usually only provides feedback on volume or frequency of a recording, and newcomers often are unable to use this type of feedback to create recordings with optimal sound quality.

Active Capture is a paradigm for media production that combines capture, interaction, and processing. Active Capture systems use an iteration loop between the human and the machine to improve the quality of produced media. Active Capture systems aim to reduce the amount of effort required to produce high-quality media. These systems have been used to help people create better videos and photos by guiding users towards better framing or better vantage points using automated video quality feedback. However, the metrics used to evaluate the quality of visual media do not apply to sound recordings, and therefore cannot help users improve sound quality.

Some prior techniques provide tools to assist users with speech quality. For example, one prior technique uses speech and image processing to provide capture-time feedback on the way a person presents themselves: amount of eye contact with the camera, speech speed, and pitch. Another prior technique provides feedback on a number of measures that impact speech performance quality. The feedback is focused on speech performance characteristics, such as emphasis, variety, flow, and diction. The user first records speech and then edits the recording using the feedback. The user then records the speech again using the edited recording as a guide, leading to a better speech performance. However, these prior techniques focus on performance quality of the text of the speech, rather than sound quality.

One aspect of sound quality is room acoustics quality. When recording speech in a room, sound waves reach the microphone directly, and also indirectly via reflections off of walls and other surfaces in the room. The effect that these reflections have on the recording depends on the room acoustics. The reflections are called indirect sound, and speech and other sound sources are called direct sound. The quality of a recording is strongly influenced by the ratio between the direct and indirect sound. The size of and material of the surfaces in the room can impact sound quality. Similarly, the relative positions of the speaker and the microphone can impact sound quality. If the user is close to the microphone and is speaking inside the microphone's pick-up region (e.g. into the correct side of the microphone, rather than the side or rear of the mic), the direct sound will dominate the indirect sound, resulting in better recording quality.

One sound quality measure of room acoustics quality is speech transmission index (STI). The speech transmission index (STI) measures the effect a recording environment has on a recording. Specifically, it measures how the recording environment (e.g., a room) warps the modulations of speech at frequencies that are important to speech perception. STI ranges between 0 and 1, where 0 indicates that the room has distorted the speech to noise, and 1 indicates that the room has no effect on the speech. STIs above 0.75 are considered usable for public address systems, while STIs above 0.95 are found in professionally recorded speech. STI measurement typically requires specialized sound sources, equipment, and access to the recording environment.

Another aspect of sound quality is background noise, and one sound quality measure of background is signal to noise ratio. Generally, sound quality can be impacted by the amount of background noise in the recording. Not turning off background noise sources (e.g. air conditioners or fans or other appliances), placing the mic too close, or pointing the mic towards a noise source are common mistakes for amateurs. These mistakes result in a recording with a low signal to noise ratio (SNR). The SNR is computed by dividing the power of the signal (speech) by the power of the noise. Professional voice recordings will generally have very high SNR.

Generally, conventional measures of sound quality are used during post-processing. For example, users often follow a post-processing paradigm where they record audio and then edit the recording using audio enhancement tools such as denoisers and dereverberators. However, such post-processing audio enhancement tools often leave behind audible artifacts, and often only work in a limited set of cases. There are several automated sound quality measures such as Perceptual Evaluation of Speech Quality (PESQ), Perceptual Evaluation of Audio Quality (PEAQ), and Short-Time Objective Intelligibility (STOI), and a limited number of techniques have been developed to estimate sound quality directly from speech audio without comparing it to a reference "clean" recording. However, none of these sound quality measures have been incorporated into a real-time recording interface, and post-processing based on these sound quality measures often achieves imperfect results. As such, there is a need for a tool that assists users in producing high-quality sound recordings without the need for post-processing.

Accordingly, embodiments of the present invention are directed to facilitating real-time sound quality prediction. At a high level, a sound quality prediction system can analyze the sound quality of a sound recording in real-time and present real-time feedback about the sound quality to facilitate changes to the recording setup that improve sound quality. The sound quality prediction system can analyze any measure of sound quality, including the impact of the room on a recording (e.g., room acoustics quality), the amount of background noise present in the recording (e.g., signal to noise ratio), and the like. In some embodiments, speech transmission index can be measured to quantify the effect of the room on a sound recording, and signal to noise can be measured to quantify the background noise. The sound quality measures can be integrated into an interface to present real-time feedback, such as a visual indicator of the sound quality measures. In some embodiments, the sound quality measures can be smoothed and/or a corresponding indicator can be updated based on consistency of the sound quality measure. As such, the sound quality prediction system can assist even amateurs in producing high-quality sound recordings.

In embodiments that use speech transmission index (STI) as a measure of sound quality, the STI can be measured in real-time by sampling a voice recording and estimating STI with a convolutional neural network. The network can be trained with a synthetic dataset of reverberant speech with known STI values for each example in the dataset. The reverberant speech can be generated by convolving clean recordings with impulse responses, and the impulse responses can be used to compute corresponding STI values. The network can use any suitable receptive field, such as one second of reverberant speech. The output of the network is the corresponding STI for the impulse response used to produce the reverberant speech. As such, the trained network can reliably predict speech transmission index from reverberant speech. A network architecture can be implemented with a suitable number of parameters for real-time applications (e.g., 40,000 in one non-limiting example). By using a convolutional neural network to measure STI, the sound quality prediction system can present an indicator of real-time STI measurements to help users identify an optimal recording setup faster than in conventional techniques.

In embodiments that use signal to noise ratio (SNR) as a measure of sound quality, the SNR can be measured in real-time by sampling a sound recording and calculating SNR using any suitable technique. In embodiments where the sound recording is a voice recording, the sound quality prediction system can identify which parts of the recording are speech and which are noise using a voice activity detector, and generate different segments for the parts that are speech and those that are noise. The sound quality prediction system can compute volumes for the speech and the noise segments, and compare the volumes to estimate SNR. The sound quality prediction system can use these SNR measurements to provide real-time feedback to help users optimize their recording setup.

Any number of sound quality measures can be incorporated into a real-time feedback interface. For example, the sound quality prediction system can record sound or otherwise access a sound recording. An audio buffer can maintain a designated duration of audio data (e.g., 5 seconds), and the audio data can be analyzed to calculate a sound quality measure. For example, a sound quality measure can be calculated from a designated frame (e.g., 1 second) from the buffer periodically, on demand, upon the occurrence of some condition (e.g., positive voice detection), or some combination thereof. In one non-limiting example, the buffer can be analyzed whenever queried to calculate output values for speech transmission index and signal to noise ratio. A given sound quality measure (e.g., STI or SNR measurements) can be smoothed (e.g., by computing a running average of measurements) and sent for presentation. In some embodiments, if there is no vocal activity detected (e.g., in a given frame), a sound quality measure is not computed, and an indication that there is no vocal activity is reported.

Upon calculating or receiving a sound quality measure, feedback about the sound quality measure can be presented. For example, real-time visual feedback indicating room acoustics quality and background noise level can be presented on a graphical user interface (GUI), which may be the same interface used for recording. The real-time visual feedback can be presented in any suitable manner. For example, visual feedback for each sound quality measure can be presented in a corresponding region of the GUI, in any suitable shape or size. The regions can be presented with a visual indicator of sound quality (e.g., color, gradient, pattern, etc.). In one embodiment, the regions can change color on a gradient from red (indicating poor sound quality) to green (indicating excellent sound quality). In some embodiments, an indicator of a sound quality measure can be updated based on consistency of the sound quality measure over time. The indicator of sound quality room acoustics quality and/or background noise level may be presented in association with a traditional volume-based visual feedback. Thus, the sound quality prediction system can provide real-time feedback on sound quality, which can help users optimize their recording setup and produce high-quality sound recordings.

As such, the sound quality prediction system described herein provides a simple feedback mechanism that reduces the effort required to optimize sound quality over prior techniques. More specifically, presentation of simple, real-time visual indicators of sound quality on a user interface (e.g., colored regions) provides valuable information, while minimizing the cognitive load required to understand a corresponding sound quality measure. Therefore, users can keep track of sound quality (for example, in their peripheral vision) while focusing on some other task (e.g., performance, reading prepared text or sheet music, and the like). Furthermore, the sound quality prediction system helps users to find the optimal recording area within a microphone's pickup pattern. The feedback from the sound quality prediction system simulates part of the expertise a recording engineer would bring to the recording session. The sound quality prediction system integrates sound quality measures directly into an interactive human-machine loop to maximize sound quality at capture-time. Using the sound quality prediction system described herein, users presented with visual feedback about sound quality can produce higher-quality voice recordings than using conventional techniques. Accordingly, the sound quality prediction system lowers the barrier to entry to creating high quality voice recordings.

Having briefly described an overview of aspects of the present invention, various terms used throughout this description are provided. Although more details regarding various terms are provided throughout this description, general descriptions of some terms are included below to provider a clearer understanding of the ideas disclosed herein:

As used herein, a sound recording, also called an audio recording, generally refers to a digital representation of sound, such as speech, music, sound effects, and the like. For example, a sound recording can be generated by sampling an audio signal and storing the samples in an audio file. The audio signal may, but need not, come from a live sound source.

A sound quality measure is any metric capable of quantifying or otherwise evaluating sound quality. Generally, sound quality can be characterized by any number of elements, such as quality of an audio source, equipment, sound environment, and the like. A sound quality measure of a sound recording can quantify or otherwise evaluate any of these elements perceptible in the recording, whether individually, by comparison, or otherwise. For example, one element of sound quality is room acoustics quality, and a corresponding sound quality measure that can quantify room acoustics quality is speech transmission index. Another element of sound quality is background noise, and a corresponding sound quality measure that can quantify background noise is signal to noise ratio. Other non-limiting examples of sound quality measures include harmonic content, attack and decay, vibrato/tremolo, distortion, and the like. These are meant as simply examples, and other sound quality measures are contemplated within the present disclosure.

As used herein, speech transmission index (STI) refers to a sound quality measures that quantifies the effect a recording environment has on a recording. Specifically, it measures how the recording environment (e.g., a room) warps the modulations of speech at frequencies that are important to speech perception. STI ranges between 0 and 1, where 0 indicates that the room has distorted the speech to noise, and 1 indicates that the room has no effect on the speech. STIs above 0.75 are considered usable for public address systems, while STIs above 0.95 are found in professionally recorded speech.

Exemple Sound Quality Prediction Environment

Referring now to FIG. 1, a block diagram of exemplary environment 100 suitable for use in implementing embodiments of the invention is shown. Generally, environment 100 is suitable for sound quality prediction, and, among other things, facilitates presentation of real-time feedback about the sound quality of a sound recording. In the embodiment illustrated in FIG. 1, environment 100 includes client device 120 and server 160, which can be any kind of computing device capable of facilitating sound quality prediction. For example, in an embodiment, client device 120 and server 160 can be a computing device such as computing device 500, as described below with reference to FIG. 5. In embodiments, client device 120 and/or server 160 can be a personal computer (PC), a laptop computer, a workstation, a mobile computing device, a PDA, a cell phone, or the like. The components of environment 100 may communicate with each other via a network 105, which may include, without limitation, one or more local area networks (LANs) and/or wide area networks (WANs). Such networking environments are commonplace in offices, enterprise-wide computer networks, intranets, and the Internet.

Environment 100 includes recording setup 110, which includes microphone 125 and client device 120 having sound quality measurement component 130. Environment 100 also includes server 160 having sound quality service 170. In this example configuration, sound quality measurement component 130 and sound quality service 170 operate in association to generate real-time feedback about the sound quality of a sound recording made with microphone 125. Although sound quality measurement component 130 and sound quality service 170 are illustrated in FIG. 1 as operating on separate components (client device 120 and server 160, respectively), other configurations are possible, such a stand-alone application performing both functions operating on client device 120 (e.g., a mobile app).

Generally, sound quality measurement component 130 and/or sound quality service 170 may be incorporated, or integrated, into an application or an add-on or plug-in to an application, or application(s). The application(s) may generally be any application capable of facilitating sound quality prediction, and may be a stand-alone application, a mobile application, a web application, or the like. In some implementations, the application(s) comprises a web application, which can run in a web browser, and could be hosted at least partially server-side. In addition, or instead, the application(s) can comprise a dedicated application. In some cases, the application can be integrated into an operating system (e.g., as a service). Although generally discussed herein as being associated with an application, in some cases, sound quality measurement component 130 and/or sound quality service 170, or portion thereof, can be additionally or alternatively integrated into the operating system (e.g., as a service) or a server (e.g., a remote server).

In the embodiment illustrated in FIG. 1, recording setup 110 includes microphone 125 communicatively coupled to client device 120 having sound quality measurement component 130. Sound quality measurement component 130 includes sampling component 140 and feedback component 150. Generally, microphone 125 picks up sound input (e.g., speech, music, sound effects, etc.), and sampling component 140 generates a sound recording by sampling audio data from the sound input. Microphone 125 includes one or more transducers that convert sound into an electrical signal, and can be a stand-alone device, a component used in a consumer electronic device such as a smart phone or other computing device, and the like. The audio data can be stored in a container audio file in any suitable form, whether uncompressed (e.g., WAV, AIFF, AU, PCM) or compressed (e.g., FLAC, M4A, MPEG, WMA, SHN, MP3). In some embodiments, the audio data is sent to server 160 for processing.

Server 160 includes sound quality service 170, which includes audio buffer 172, sound quality estimator 174, and smoothing component 176. Generally, received audio data can be stored in audio buffer 172, sound quality estimator 174 can analyze the stored audio data to compute an audio quality measure, and smoothing component 176 can perform smoothing on the computed sound quality measure. For example, audio buffer 172 can append received audio data to the buffer, which can store some designed duration of audio data (e.g., five seconds of audio). Sound quality estimator 174 can analyze audio data from audio buffer 172 to calculate a sound quality measure. For example, a sound quality measure can be calculated from a designated frame (e.g., 1 second) from the buffer periodically, on demand, upon the occurrence of some condition (e.g., positive voice detection), or some combination thereof. Generally, the buffer can implement any suitable queuing technique, such as FIFO, LIFO, or otherwise. Although a single sound quality estimator 174 is illustrated in FIG. 1, any number of sound quality estimators may be implemented to compute any number of sound quality measures. Different sound quality estimators may, but need not, have dedicated buffers, different frame sizes, and the like.

Generally, any type of sound quality measure can be calculated. In some embodiments, for each frame of audio data in audio buffer 172, sound quality service 170 can calculate a measure of room acoustics quality (e.g., speech transmission index), a measure of background noise (e.g., signal to noise ratio), and/or other sound quality measures. An example technique for calculating speech transmission index in real-time is described in more detail below. In embodiments that use signal to noise ratio (SNR) as a measure of sound quality, the SNR can be calculated using any suitable technique. In embodiments where the sound recording is a voice recording, audio data in audio buffer 172 (e.g., each frame of audio data) can be analyzed with a voice activity detector to identify and segment the parts of the audio data that are speech from parts that are noise. Voice detection can be performed using any voice activity detector, such as the voice activity detector provided by WebRTC. The volume of the speech and the noise segments can calculated and used to estimate SNR of the audio data.

In some embodiments, sound quality service 170 can calculate speech transmission index and signal to noise ratio upon being queried, for example, by feedback component 150. In embodiments involving voice recordings, sound quality service 170 can perform voice detection on the audio data (e.g., on each second of audio data in the buffer) and may only calculate speech transmission index and/or signal to noise ratio upon determining that the audio data contains speech. These and other variations are contemplated within the present disclosure.

In some embodiments, sound quality service 170 can provide a calculated sound quality measure (e.g., speech transmission index and signal to noise ratio) to sound quality measurement component 130 to facilitate presentation of feedback about the sound quality measure. Additionally or alternatively, smoothing component 176 can apply smoothing to one or more computed sound quality measures before presentation of the feedback. Generally, there are a number of idiosyncrasies with speech that can impact a particular sound quality measure, for example, of a particular frame of audio data. For example, speech transmission index has less predictive power for some syllabus and phonemes than for others. In some circumstances, speech transmission index can be determined more accurately for speech with many consonants than for speech with longer vowel sounds. As such, subsequent presentation of raw STI values could produce a fluctuating indicator that does not always correspond with changes in recording setup, leading to a poor user experience. As such, application of smoothing to computed STI values can increase the likelihood that changes in reported STI values actually result from changes made to a recording setup. Any type of smoothing can be applied, including statistical computations performed over time (e.g., running average, median, etc.), any suitable filtering technique, and the like. Accordingly, the smoothed sound quality measure can be provided to sound quality measurement component 130 to facilitate presentation of feedback about the sound quality measure.

Blind Estimate of Speech Transmission

In some embodiments, speech transmission index is computed (e.g., by sound quality estimator 174 of FIG. 1) and used as a sound quality measure. At a high level, speech transmission index provides a measure of speech intelligibility in a sound recording. The study of speech intelligibility is the study of how comprehensible speech is to listeners, given environmental conditions. These conditions include background noise level, reverberation characteristics (e.g. reverberation time), and distortions in the sound producing equipment (e.g. low quality loudspeaker). Many sound quality measures have been proposed for objective evaluation of speech intelligibility, such as Perceptual Evaluation of Speech Quality (PESQ), Perceptual Evaluation of Audio Quality (PEAQ), and Short-Time Objective Intelligibility (STOI). One of the most successful measures to date is the speech transmission index (STI). The speech transmission index of a listening position within a given environment (e.g., a room) reliably indicates the quality and intelligibility of speech uttered in that environment.

Generally, the concept of speech transmission index is based on the observation that the impact an environment has on the spectro-temporal modulations of speech is correlated with speech intelligibility. If these modulations are kept intact, the environment has a high speech transmission index. If the modulations are destroyed or smeared, the speech transmission index is low. Modulations of speech can be destroyed by reverberation or excessive background noise.

The speech transmission index ranges from 0 (worst) to 1 (best). This range covers a wide variety of acoustic conditions from large public spaces like sports stadiums (around 0.3 to 0.6) to bedrooms and offices (around 0.8 to 0.9) all the way up to professional recording studios (around 0.97 and above). The measure is very reliable for predicting speech intelligibility in many room conditions. STI can be used to distinguish pleasant recording scenarios (such as those on professional radio programs) from amateur recordings (such as podcasts recorded in a living room).

The speech transmission index is conventionally measured by estimating the transfer function of a given room with respect to given speaker and listener positions. This is a laborious manual process that can be performed by creating a signal that mimics the modulations of speech in different frequency bands, playing it through a high quality loudspeaker, and recording the output with a high quality microphone. This process takes up to 15 minutes in good conditions. STI can alternatively be computed from a measurement of the room impulse response, the measurement of which is also laborious. Further, it is not always possible to take an STI measurement of a space (e.g. in public spaces like a subway platform). Therefore, the STI for most prerecorded audio cannot be calculated.

One prior technique calculates speed transmission index by computing it from an approximation of the impulse response of a room. The approximation is derived using a generalization of Schroeder's room impulse response model and has three parameters: the reverberation time, the gain factor, and the order of the impulse response. Estimating these three parameters is constrained by the behavior of the spectro-temporal modulations of the observed, reverberant speech. However, this technique relies on accurate estimation of these three parameters and a realistic model for room impulse responses. Furthermore, this technique was developed for and limited to acoustic conditions with STIs between 0.4 and 0.8. As such, it is unavailable for use with STIs corresponding to some common acoustic conditions.

In some embodiments, the speech transmission index can be estimated from sound recordings of speech, circumventing the need to take an STI measurement with specialized sound sources (modulated noise) and equipment (high quality microphones and loudspeakers). To accomplish this, the sound quality prediction system described herein can use a convolutional neural network (e.g., which may correspond to sound quality estimator 174 of FIG. 1) to compute a regression from time series audio of speech to the speech transmission index for that room. The STI-estimation technique described herein can be implemented in any number of applications, including identification of high quality speech data in large unlabeled speech datasets (e.g., LibriVox recordings), informing users of recording software of problems in their recording setup, diagnosing problems for speech recognition systems (e.g., telling users to move their smart home device to locations where the speech transmission index is higher for more reliable usage), and the like. Unlike the prior STI-estimation techniques, the present technique can operate over a broader spectrum of STIs, all the way up to 0.99 (professional recording studios). This broader spectrum includes STIs corresponding to excellent recordings (e.g. recordings from professional radio programs) and amateur recordings (e.g. recordings from amateur podcast producers).

The convolutional neural network can be generated with any suitable architecture. One suitable architecture is shown in Table 1. In this example, the input to the network is 1 second of audio data of batch size N (e.g., pulse code modulation (PCM) audio) that is passed through a series of convolutional layers. The first convolutional layer computes a spectrogram representation of the input audio data with 128 filters of length 128 samples (8 ms at 16 kHz) with a hop size of 64 samples. The weights of this layer are initialized with a Fourier basis (sine waves at different frequencies) and are updated during training to find an optimal spectrogram-like transform for an STI computation. The learned time-frequency representation can be passed through a series of 2D convolutions, leaky rectified linear units (ReLU) units, and batch normalization layers. The size of the representation can be halved at each layer until a desired length of audio data (e.g., 1 second) maps onto a single number. The output of the last convolutional layer can be passed through a sigmoid activation unit to map the output between 0 and 1 (the lower and upper bound for STI, respectively).

TABLE 1

Example Convolutional Neural Network Architecture for STI Estimation

| Layer type | # of Filters | Output Shape | Filter Size, Stride | Activation Function | Notes |
|---|---|---|---|---|---|
| Input | — | (N, 1, 16000) | — | — | 1 second audio |
| Conv (1D) | 128 | (N, 128, 253) | 128, 64 | — | Fourier initialization |
| Conv (1D) | 128 | (N, 128, 253) | 5, 1 | — | Spectrogram smoothing |
| Conv (2D) | 8 | (N, 8, 253) | (128, 1), (128, 1) | Leaky ReLU | Batch normalization before Leaky ReLU |
| Conv (2D) | 16 | (N, 16, 111) | (1, 32), (1, 2) | Leaky ReLU | Batch normalization before Leaky ReLU |
| Conv (2D) | 32 | (N, 32, 40) | (1, 32), (1, 2) | Leaky ReLU | Batch normalization before Leaky ReLU |
| Conv (2D) | 1 | (N, 1, 5) | (1, 32), (1, 2) | — | — |
| Conv (2D) | 1 | (N, 1) | (1, 5) | Sigmoid | — |

The convolutional neural network can use any suitable receptive field, that is, how much audio data the neural network analyzes at a given time. In the embodiment described above, the neural network has a receptive field of 1 second of audio data, but other sizes are possible. Generally, there is a tradeoff between a larger receptive field (providing greater accuracy, but larger latency) and a smaller receptive field (providing less latency, but less accuracy).

Selection of a larger receptive field (e.g., on the order of seconds) can impact the user experience. For example, a user may make a recording from a particular location and have to wait for a measurement to stabilize (e.g., before moving to another location and making another measurement). Given the improved measurement accuracy, this latency may be acceptable for a particular application. On the other hand, smaller receptive fields may provide faster response times, but can face physical limitations based on recording equipment and the physics of reverberation. For example, it can be difficult to capture reverb in smaller receptive fields, as the time scale of some reverb can occur over seconds. Given the faster response time, a smaller receptive field can provide sufficient accuracy for some applications. In some embodiments, parallel measurements can be performed, for example, using multiple microphones and neural networks with different receptive fields (e.g., one with a long window and one with a short window). Generally, any suitable size for a receptive field can be selected for a particular application. Further, although some architectures can be implemented using a designated size for the receptive field, this need not be the case, as some architectures can be implemented without a predetermined size for a receptive field. For example, some architectures such as a recurrent neural network can facilitate sampling within a dynamic window. These are simply meant as examples, and any suitable architecture can be implemented.

Generally, a training dataset for the convolutional neural network includes audio data labeled with corresponding speech transmission indices. Any suitable training dataset can be used. Generally, audio data can be recorded and/or obtained, and corresponding STI values can be measured and/or calculated using any known technique. In one example, a training dataset can be derived from a collection of audio and/or speech recordings, such as those available from the DAPS (device and produced speech) dataset. The clean version of the recordings in the DAPS dataset consists of twenty speakers (ten male, ten female) reading five excerpts from public domain stories (about 14 minutes per speaker—280 minutes for the entire dataset). The collection of audio recordings (e.g., the clean recordings from DAPS) can be split (e.g., randomly) into training and testing sets (e.g., each consisting of 10 speakers—5 male and 5 female—140 minutes of clean speech). The recordings can be segmented into chunks (e.g., 1 second chunks with no overlap). Chunks that do not contain speech can be removed. The recordings can be downsampled (e.g., to 16000 Hz) to reduce computational cost. The resulting audio data can be used as training inputs.

In some embodiments, a library of impulse responses can be obtained and/or simulated. Generally, data augmentation can be performed to increase the amount of training data available. As such, a library of artificial impulse responses can be generated using a room impulse simulator across a variety of room conditions. Room dimensions can be varied (e.g., from 5 meters to 20 meters) along each axis (height, width, and depth). Absorption coefficients for each wall can be chosen from a predetermined set (e.g., [0.01, 0.1, 0.3, 0.5]). The room impulse responses can be generated using the known image-source method. Source (e.g. speech) can be placed at a desired location (e.g., ⅓ the height, width, and depth of the room). Virtual microphone locations can be sampled at varying distances from the source. Impulse responses can be computed for every microphone-source pair in every room. As such, a library of artificial impulse responses (e.g., 1000) can be generated. A first subset (e.g., 500) of these can be placed in a training dataset and a second subset (e.g., the other 500) can be placed in a testing dataset. Speech transmission index can be computed for each impulse response using any known technique.

The training input audio files discussed above can be used with the (generated) impulse responses and corresponding speech transmission indices to create a dataset. In one example, a dataset can be generated on the fly during training. For example, a random selection of n training input audio files (e.g., 1-second audio excerpts) can be selected. A random selection of n impulse responses can be selected from the impulse response dataset. Each training input audio file (e.g., 1-second audio excerpt) can be convolved with the corresponding impulse response to produce a reverberant speech signal. The reverberant speech signal can be paired with the speech transmission index corresponding to the impulse response used to generate the reverberant speech, forming a labeled example (audio signal and speech transmission index). These and other variations for accessing and/or generating training data are contemplated.

The convolutional neural network can be trained using any suitable technique. For example, training can be performed using an optimization algorithm (e.g., ADAM optimization) with a designated loss function (e.g., mean squared error between the predicted and ground truth speech transmission index). Any suitable learning rate may be used (e.g., 0.001) for any suitable number of epochs (e.g., 200) and any suitable batch size (e.g., 32). For example, an epoch can be a pass over every clean speech sample in a training dataset, convolved with some set of impulse responses (e.g., from a simulated set of impulse responses). In embodiments where training data includes 1 second of reverberant speech, 200 epochs corresponds to roughly 322 hours of training data.

Sound Quality Feedback

Returning now to FIG. 1, feedback component 150 can receive a stream of computed and/or smoothed values for one or more sound quality measures from sound quality service 170. In some embodiments, upon receiving values for a sound quality measure, feedback component 150 can present feedback about the values. For example, real-time visual feedback indicating room acoustics quality and background noise level can be presented on a graphical user interface (GUI), which may be the same recording interface used to generate the sound recording that was analyzed. Generally, the feedback is real-time in the sense that it reflects a sound quality measure for a live recording such that the feedback can be used to optimize recording setup 110 (e.g., by moving or rotating microphone 125, by changing its location relative to a sound source, etc.). Although the feedback is described in some embodiments as being visual feedback, this need not be the case. Any type of feedback (e.g., visual, audible, haptic, etc.) can be presented using any type of I/O component.

Figure 2:
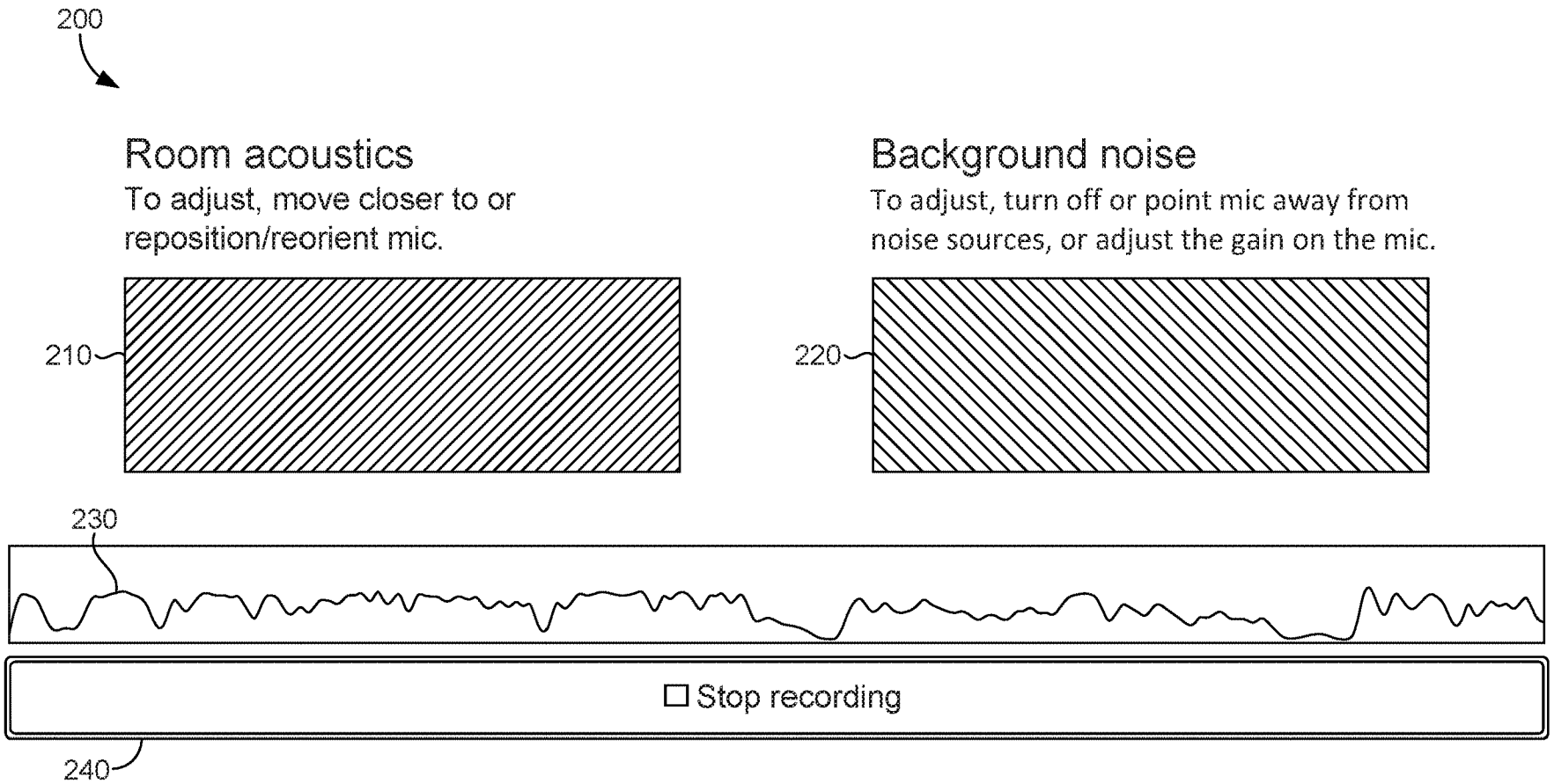
FIG. 2 illustrates an example sound quality feedback interface, in accordance with embodiments of the present invention.

The real-time feedback can be presented in any suitable manner. For example, visual feedback for each sound quality measure can be presented in a corresponding region of a GUI, in any suitable shape or size. FIG. 2 illustrates an example sound quality feedback interface, in accordance with embodiments of the present invention. In FIG. 2, GUI 200 may include an interaction element (e.g., a button) that can initiate recording, transmission of audio data to a sound quality service (e.g., sound quality service 170 of FIG. 1), and/or presentation of feedback about a sound quality measure for the recording.

In the embodiment illustrated in FIG. 2, GUI 200 presents visual feedback for two sound quality measures, room acoustics (region 210) and background noise (region 220).

The regions can be presented with a visual characteristic (e.g., color, gradient, pattern, etc.) that reflects a corresponding sound quality measure (e.g., STI and SNR, respectively). In one embodiment, the regions can change color on a gradient from red (indicating poor sound quality) to green (indicating excellent sound quality). In some embodiments, when speech is not detected, the visual feedback can be updated to reflect the absence of detected speech data (e.g., by greying out regions 210 and 220). In some embodiments, GUI 200 can include a visual indicator illustrating the amplitude of the sound recording (e.g., waveform 230), and an interaction element (e.g., button 240) can be provided to stop recording. As such, GUI 200 can provide real-time feedback on sound quality, which can help users optimize their recording setup and produce high-quality sound recordings.

In some embodiments, an indicator of a sound quality measure can be updated based on consistency of the sound quality measure over time. Additionally or alternatively to smoothing being performed (e.g., by smoothing component 176 of FIG. 1), values of a sound quality measure can be evaluated for consistency (e.g., by sound quality consistency component 155 of FIG. 1) before updating the indicator of a particular sound quality measure. For example, one or more consistency criteria can be applied to consecutive values, or values within a window, from a stream of values for a particular sound quality measure. An indicator can be updated based on any number of consistency criteria, such as a tolerance within which samples can be considered consistent, a threshold number or concentration of consecutive consistent values required before updating an indicator, a threshold time duration within which values must be consistent before updating an indicator, and the like.

In some embodiments, one or more consistency criteria can be adjustable to control how responsive the interface is. For example, an interaction element (e.g., a knob, slider, field, drop down list, etc.) can be user selectable to adjust one or more of the consistency criteria. Adjustments to the consistency criteria can control the delay on how fast an indicator is updated based on a changing sound quality measure. More stringent consistency requirements can prevent fast transients and outlier values of a particular sound quality measure from updating an indicator, but may require a user to maintain high sound quality over a longer period of time.

As such, a simple feedback mechanism can be provided that reduces the effort required to optimize sound quality over prior techniques. For example, presentation of simple, real-time visual indicators of sound quality on a user interface (e.g., colored regions) provides valuable information, while minimizing the cognitive load required to understand a corresponding sound quality measure. Therefore, users can keep track of sound quality (for example, in their peripheral vision) while focusing on some other task (e.g., performance, reading prepared text or sheet music, and the like).

Exemplary Flow Diagrams

Figure 3:
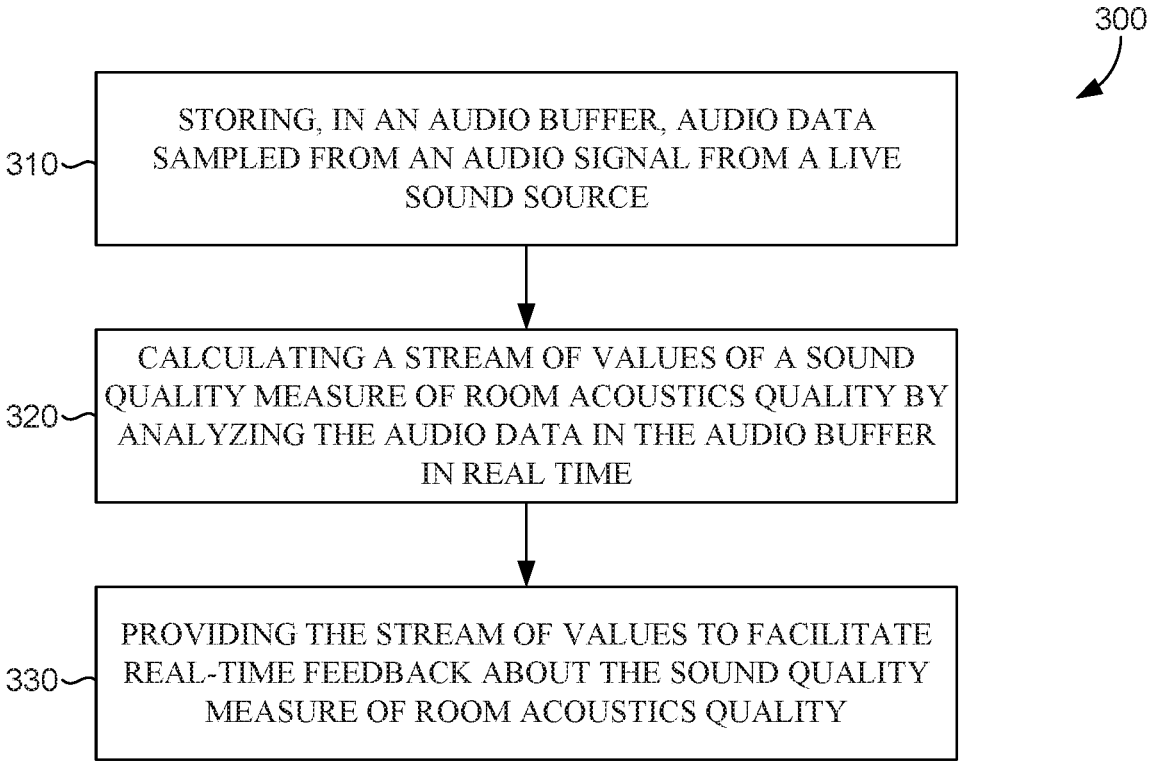
FIG. 3 is a flow diagram showing a method for sound quality prediction, in accordance with embodiments of the present invention.
Figure 4:
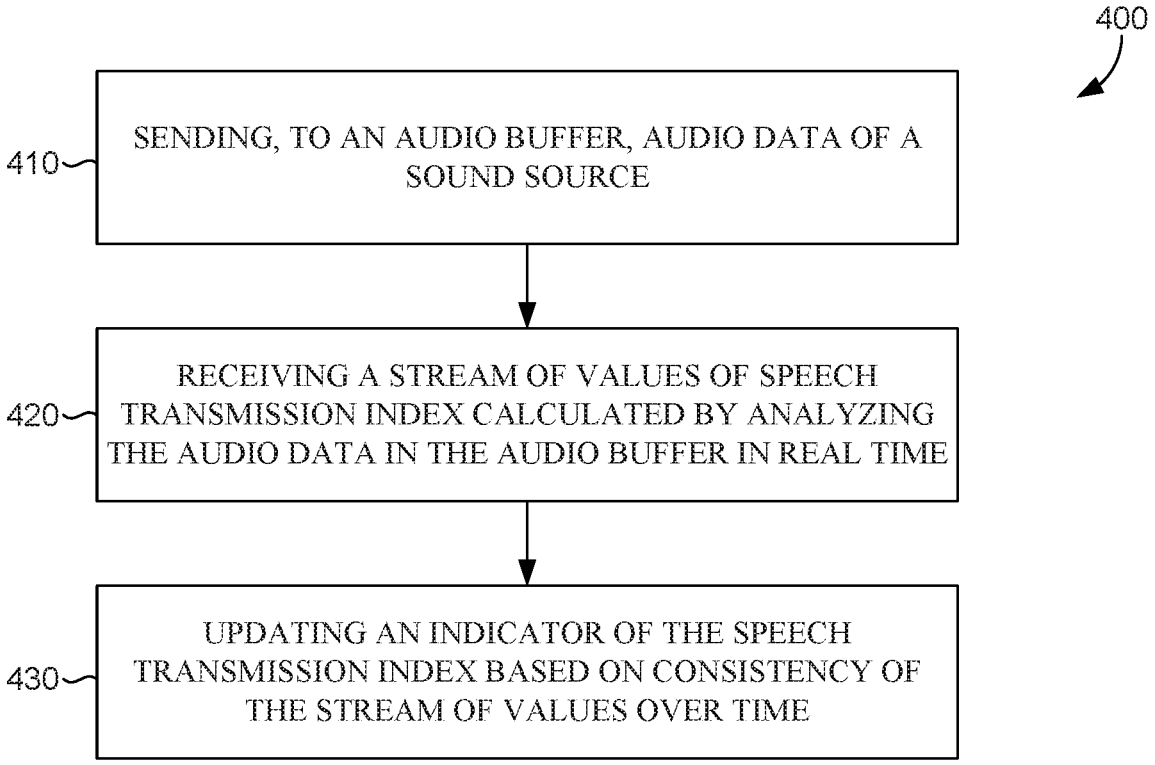
FIG. 4 is a flow diagram showing a another method for sound quality prediction, in accordance with embodiments of the present invention.

With reference now to FIGS. 3-4, flow diagrams are provided illustrating methods for sound quality prediction. Each block of the methods 300 and 400 and any other methods described herein comprise a computing process performed using any combination of hardware, firmware, and/or software. For instance, various functions can be carried out by a processor executing instructions stored in memory. The methods can also be embodied as computer-usable instructions stored on computer storage media. The methods can be provided by a standalone application, a service or hosted service (standalone or in combination with another hosted service), or a plug-in to another product, to name a few. For example, methods 300, 400, and 500 can be performed by sound quality measure component 130 and/or sound quality service 170 of FIG. 1.

Turning initially to FIG. 3, a method 300 for sound quality prediction is illustrated, in accordance with embodiments described herein. Initially at block 310, audio data sampled from an audio signal from a live sound source is stored in an audio buffer. For example, the live sound source can be a vocal performance, and the audio signal can be generated by a microphone. At block 320, a stream of values of a sound quality measure of room acoustics quality is calculated by analyzing the audio data in the audio buffer in real time. For example, the sound quality measure can be speech transmission index. In some embodiments, speech transmission index is calculated using a convolutional neural network to calculate a value of speech transmission index for each frame of audio data in the audio buffer. In some embodiments, the values can be smoothed, for example, by computing a running average or performing some other statistical analysis of the values. At block 330, the stream of values is provided to facilitate real-time feedback about the sound quality measure of room acoustics quality. For example, a visual indicator of the values of the sound quality measure can be presented on a graphical user interface. Any number of variations will be understood and are contemplated within the present disclosure.

Turning now to FIG. 4, a method 400 for sound quality prediction is illustrated, in accordance with embodiments described herein. Initially at block 410, audio data of a sound source is sent to an audio buffer. The sound source can be a live sound source (e.g., a performance), previously record audio, synthesized audio, or otherwise. At block 420, a stream of values of speech transmission index, calculated by analyzing the audio data in the audio buffer in real time, is received. The stream of values can be computed using a sound quality service that may include a convolutional neural network trained to compute sound transmission index from reverberant audio. At block 430, an indicator of the speech transmission index is updated based on consistency of the stream of values over time. Any number of variations will be understood and are contemplated within the present disclosure.

Figure 5:
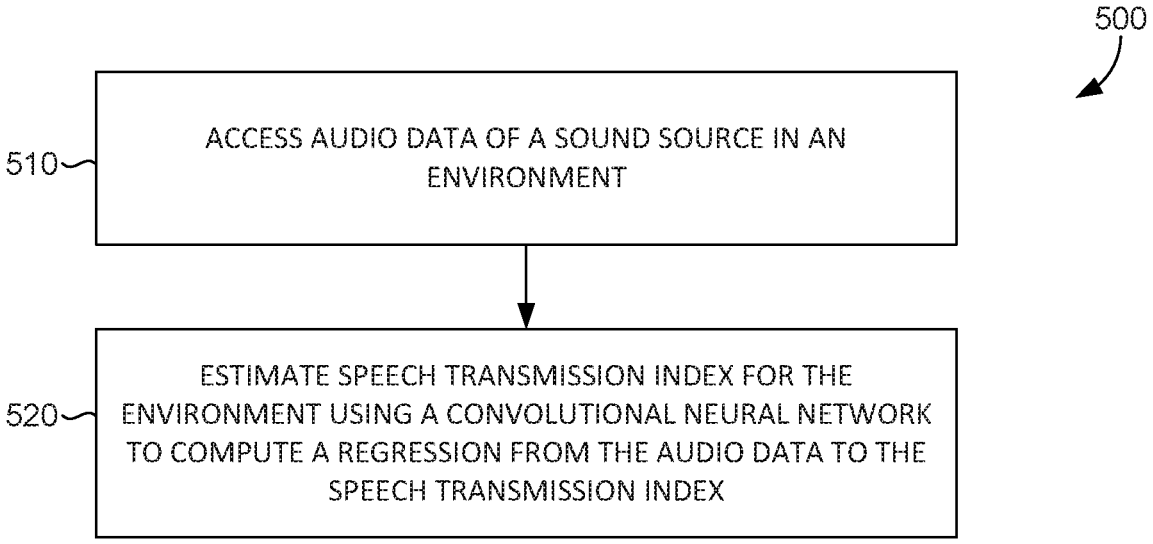
FIG. 5 is a flow diagram showing a another method for speech transmission index prediction, in accordance with embodiments of the present invention.

Turning now to FIG. 5, a method 500 for speech transmission index prediction is illustrated, in accordance with embodiments described herein. Initially at block 510, audio data of a sound source in an environment is accessed. The sound source can be a live sound source (e.g., a performance), previously record audio, synthesized audio, or otherwise. The environment can be a room in which the audio data is recorded. At block 520, speech transmission index for the environment is estimated using a convolutional neural network to compute a regression from the audio data to the speech transmission index. The convolutional neural network can be configured to analyze a designated receptive field of the audio data (e.g., 1 second of reverberant audio) that is passed through a series of convolutional layers. The convolutional layers can include a Fourier transformation, a 2D convolution, a leaky rectified linear unit (ReLU) units, a batch normalization layer, some combination thereof, or otherwise. The convolutional neural network can be trained using any suitable dataset. Generally, audio data can be recorded and/or obtained, and corresponding STI values can be measured and/or calculated using any known technique. In one example, a training dataset can be derived from a collection of audio and/or speech recordings. For example, a library of artificial impulse responses can be generated, speech transmission index can be computed for each impulse response, and audio data from the recordings can be convolved with one of the impulse responses and paired with the corresponding speech transmission index. Any variation of the foregoing will be understood and is contemplated within the present disclosure.

Exemplary Operating Environment

Figure 6:
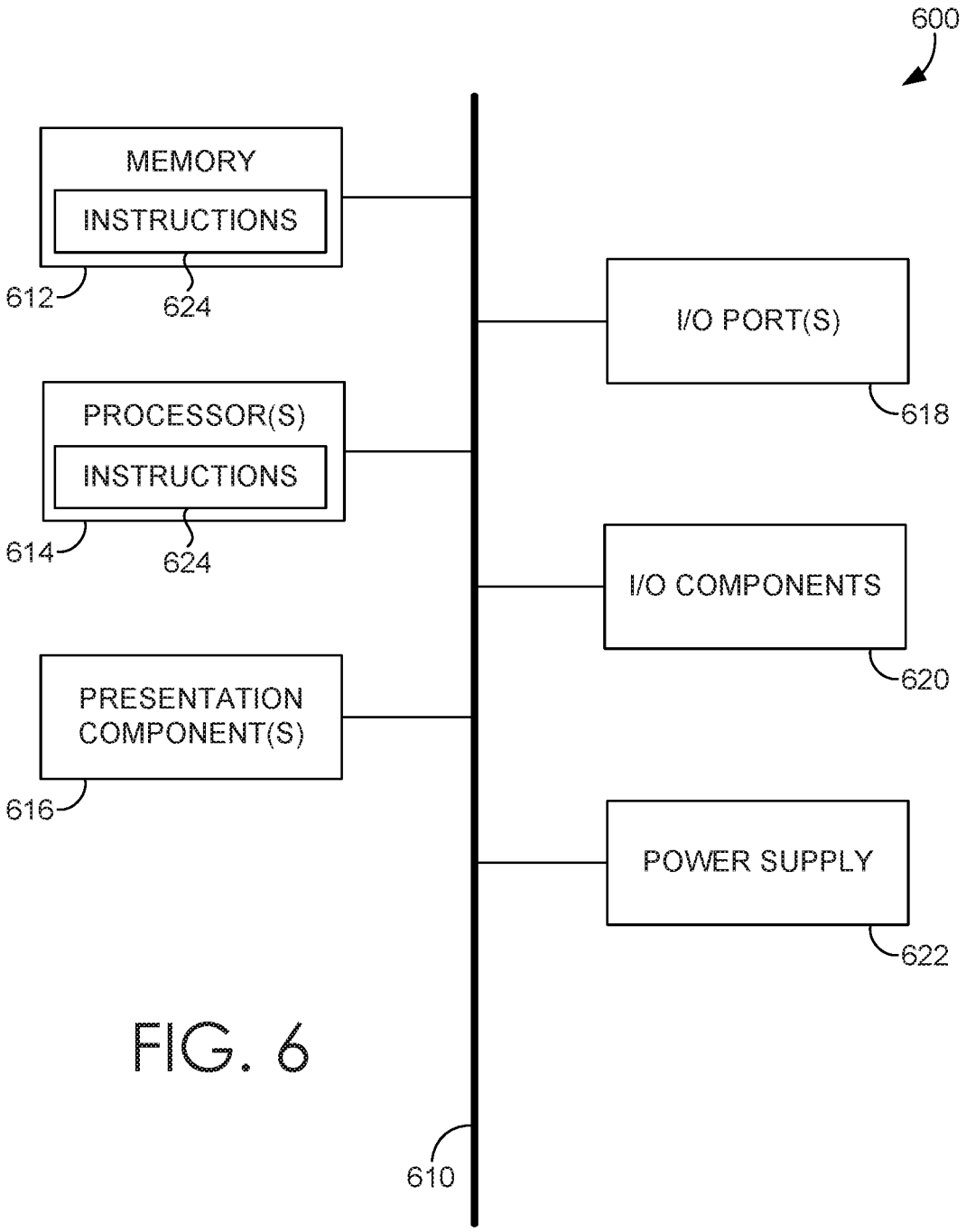
FIG. 6 is a block diagram of an exemplary computing environment suitable for use in implementing embodiments of the present invention.

Having described an overview of embodiments of the present invention, an exemplary operating environment in which embodiments of the present invention may be implemented is described below in order to provide a general context for various aspects of the present invention. Referring now to FIG. 6 in particular, an exemplary operating environment for implementing embodiments of the present invention is shown and designated generally as computing device 600. Computing device 600 is but one example of a suitable computing environment and is not intended to suggest any limitation as to the scope of use or functionality of the invention. Neither should computing device 600 be interpreted as having any dependency or requirement relating to any one or combination of components illustrated.

The invention may be described in the general context of computer code or machine-useable instructions, including computer-executable instructions such as program modules, being executed by a computer or other machine, such as a cellular telephone, personal data assistant or other handheld device. Generally, program modules including routines, programs, objects, components, data structures, etc., refer to code that perform particular tasks or implement particular abstract data types. The invention may be practiced in a variety of system configurations, including hand-held devices, consumer electronics, general-purpose computers, more specialty computing devices, etc. The invention may also be practiced in distributed computing environments where tasks are performed by remote-processing devices that are linked through a communications network.

With reference to FIG. 6, computing device 600 includes bus 610 that directly or indirectly couples the following devices: memory 612, one or more processors 614, one or more presentation components 616, input/output (I/O) ports 618, input/output components 620, and illustrative power supply 622. Bus 610 represents what may be one or more busses (such as an address bus, data bus, or combination thereof). Although the various blocks of FIG. 6 are shown with lines for the sake of clarity, in reality, delineating various components is not so clear, and metaphorically, the lines would more accurately be grey and fuzzy. For example, one may consider a presentation component such as a display device to be an I/O component. Also, processors have memory. The inventor recognizes that such is the nature of the art, and reiterates that the diagram of FIG. 6 is merely illustrative of an exemplary computing device that can be used in connection with one or more embodiments of the present invention. Distinction is not made between such categories as "workstation," "server," "laptop," "hand-held device," etc., as all are contemplated within the scope of FIG. 6 and reference to "computing device."

Computing device 600 typically includes a variety of computer-readable media. Computer-readable media can be any available media that can be accessed by computing device 500 and includes both volatile and nonvolatile media, and removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 600. Computer storage media does not comprise signals per se. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 612 includes computer-storage media in the form of volatile and/or nonvolatile memory. The memory may be removable, non-removable, or a combination thereof. Exemplary hardware devices include solid-state memory, hard drives, optical-disc drives, etc. Computing device 600 includes one or more processors that read data from various entities such as memory 612 or I/O components 620. Presentation component(s) 616 present data indications to a user or other device. Exemplary presentation components include a display device, speaker, printing component, vibrating component, etc.

I/O ports 618 allow computing device 600 to be logically coupled to other devices including I/O components 620, some of which may be built in. Illustrative components include a microphone, joystick, game pad, satellite dish, scanner, printer, wireless device, etc. The I/O components 620 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of computing device 600. Computing device 600 may be equipped with depth cameras, such as stereoscopic camera systems, infrared camera systems, RGB camera systems, touchscreen technology, and combinations of these, for gesture detection and recognition. Additionally, the computing device 600 may be equipped with accelerometers or gyroscopes that enable detection of motion. The output of the accelerometers or gyroscopes may be provided to the display of computing device 600 to render immersive augmented reality or virtual reality.

Embodiments described herein support sound quality prediction. The components described herein refer to integrated components of a sound quality prediction system. The integrated components refer to the hardware architecture and software framework that support functionality using the sound quality prediction system. The hardware architecture refers to physical components and interrelationships thereof and the software framework refers to software providing functionality that can be implemented with hardware embodied on a device.

The end-to-end software-based sound quality prediction system can operate within the system components to operate computer hardware to provide system functionality. At a low level, hardware processors execute instructions selected from a machine language (also referred to as machine code or native) instruction set for a given processor. The processor recognizes the native instructions and performs corresponding low level functions relating, for example, to logic, control and memory operations. Low level software written in machine code can provide more complex functionality to higher levels of software. As used herein, computer-executable instructions includes any software, including low level software written in machine code, higher level software such as application software and any combination thereof. In this regard, the system components can manage resources and provide services for the system functionality. Any other variations and combinations thereof are contemplated with embodiments of the present invention.

Having identified various components in the present disclosure, it should be understood that any number of components and arrangements may be employed to achieve the desired functionality within the scope of the present disclosure. For example, the components in the embodiments depicted in the figures are shown with lines for the sake of conceptual clarity. Other arrangements of these and other components may also be implemented. For example, although some components are depicted as single components, many of the elements described herein may be implemented as discrete or distributed components or in conjunction with other components, and in any suitable combination and location. Some elements may be omitted altogether. Moreover, various functions described herein as being performed by one or more entities may be carried out by hardware, firmware, and/or software, as described below. For instance, various functions may be carried out by a processor executing instructions stored in memory. As such, other arrangements and elements (e.g., machines, interfaces, functions, orders, and groupings of functions, etc.) can be used in addition to or instead of those shown.

The subject matter of the present invention is described with specificity herein to meet statutory requirements. However, the description itself is not intended to limit the scope of this patent. Rather, the inventor has contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. One or more computer storage media storing computer-useable instructions that, when used by one or more computing devices, cause the one or more computing devices to perform operations comprising:

storing, in an audio buffer, audio data of a live recording of a live sound source;

calculating a stream of values of speech transmission index during the live recording by, for a given frame of audio data from the audio buffer, using a particular layer of a convolutional neural network (CNN) to compute a time-frequency representation of the audio data in the frame and using subsequent layers of the CNN to compute the values of speech transmission index from the time-frequency representation; and providing the stream of values to facilitate feedback about the speech transmission index during the live recording.

2. The one or more computer storage media of claim 1, wherein the speech transmission index quantifies an impact of a recording environment on sound quality during the live recording.

3. The one or more computer storage media of claim 1, wherein calculating the stream of values of speech transmission index comprises using the CNN to compute a regression from the audio data to the values of speech transmission index.

4. The one or more computer storage media of claim 1, the operations further comprising, for each frame of audio data from the audio buffer, calculating a corresponding one of the values of speech transmission index upon detecting speech in the frame.

5. The one or more computer storage media of claim 1, wherein calculating the stream of values of speech transmission index includes smoothing the values by performing a running average of a consecutive set of the values to generate the stream of values.

6. The one or more computer storage media of claim 1, the operations further comprising training the CNN with a set of impulse responses representing ranges of room conditions.

7. The one or more computer storage media of claim 1, the operations further comprising, for frames of audio data from the audio buffer:

segmenting the audio data in each frame into a first segment of speech and a second segment of noise; and computing a stream of values of a signal-to-noise ratio based on the first segment of speech and the second segment of noise for each frame.

8. A computerized method comprising:

sending, to an audio buffer, audio data of a sound source;

receiving a stream of consecutive values of speech transmission index calculated by analyzing different portions of the audio data in the audio buffer; and updating an indicator of the speech transmission index based on consistency, of a set of the consecutive values of the speech transmission index, within a window of time.

9. The computerized method of claim 8, wherein updating the indicator based on consistency of the set of the consecutive values of the speech transmission index comprises applying to the set of consecutive values a consistency criteria that is adjustable with an interaction element.

10. The computerized method of claim 8, the stream of values of speech transmission index calculated using a convolutional neural network to compute a regression from the audio data to the values of speech transmission index.

11. The computerized method of claim 8, the stream of values of speech transmission index calculated by, for each frame of audio data from the audio buffer, calculating speech transmission index upon detecting speech in the frame.

12. The computerized method of claim 8, the stream of values of speech transmission index calculated by, for a given frame of audio data from the audio buffer, passing a time-frequency representation of the audio data in the frame through a series of convolutions.

13. The computerized method of claim 8, the method further comprising, for frames of audio data from the audio buffer:

segmenting the audio data in each frame into a first segment of speech and a second segment of noise; and computing a stream of values of a signal-to-noise ratio based on the first segment of speech and the second segment of noise for each frame.

14. The computerized method of claim 8, the stream of values of speech transmission index calculated using a convolutional neural network, the method further comprising generating training data for the convolutional neural network from a library of artificial impulse responses.

15. The computerized method of claim 8, the stream of values of speech transmission index calculated using a convolutional neural network, the method further comprising generating training data for the convolutional neural network by:

convolving clean recordings with impulse responses to produce reverberant speech signals; and computing the values of speech transmission index from the impulse responses.

16. The computerized method of claim 8, wherein updating the indicator of the speech transmission index comprises informing of a problem with a recording setup.

17. The computerized method of claim 8, wherein updating the indicator of the speech transmission index comprises an identification of speech data, from an unlabeled speech dataset, having a threshold speech transmission index.

18. The computerized method of claim 8, wherein updating the indicator of the speech transmission index comprises a diagnosis of a problem with a speech recognition system.

19. The computerized method of claim 8, wherein updating the indicator of the speech transmission index based on consistency of the consecutive values of the speech transmission index comprises applying a user-adjustable consistency criteria to control how responsive the indictor the speech transmission index is.

20. A sound quality prediction system comprising:

one or more hardware processors and memory configured to provide computer program instructions to the one or more hardware processors;

an audio buffer configured to store audio data of a live recording of a live sound source;

a means for generating a stream of consecutive values of speech transmission index by analyzing different portions of the audio data in the audio buffer during the live recording; and a visualization component configured to provide the stream of the consecutive values to facilitate feedback about the audio data during the live recording.

* * * * *